United States Patent [19]

Baker

[11] Patent Number: 4,750,861

[45] Date of Patent: Jun. 14, 1988

[54] COMPRESSOR COMPONENTS SUPPORT SYSTEM

[75] Inventor: Robert L. Baker, Williamsville, N.Y.

[73] Assignee: Cooper Industries, Houston, Tex.

[21] Appl. No.: 787,282

[22] Filed: Oct. 15, 1985

[51] Int. Cl.[4] ..... F01D 25/26

[52] U.S. Cl. ..... 415/134; 415/219 C; 285/224

[58] Field of Search ..... 415/126, 134, 135, 136, 415/204, 219 B, 219 C, 207; 285/235, 368, 223, 224, 187; 60/39.32

[56] References Cited

U.S. PATENT DOCUMENTS

| | | | |
|---|---|---|---|
| 1,006,317 | 10/1911 | Tyler | 285/61 |
| 1,318,035 | 10/1919 | Watt | 415/135 |
| 2,345,540 | 3/1944 | Ray | 415/134 X |
| 2,849,960 | 9/1958 | Olmstead et al. | 415/204 |
| 3,415,285 | 12/1968 | Torp | 285/368 X |
| 4,456,200 | 6/1984 | Lamberton | 417/243 X |

FOREIGN PATENT DOCUMENTS

| | | | |
|---|---|---|---|
| 422913 | 9/1974 | U.S.S.R. | 285/368 |

*Primary Examiner*—Robert E. Garrett
*Assistant Examiner*—Joseph M. Pitko
*Attorney, Agent, or Firm*—E. E. Scott; A. R. Thiele

[57] ABSTRACT

A support system useful to interconnect interstage components in a centrifugal compressor. The system allows controlled balancing of pressure induced forces while accommodating thermal expansion and contraction. In one preferred form a support ring is mounted about a scroll volute but supported through tie rods from a conduit concentrically aligned with the volute. A second support ring is mounted about the conduit, facing but spaced from the first ring, and supported from the volute. The support rings are respectively sealed to the volute and conduit through O-rings which allow sliding axial motion. A grooved peripheral pipe coupling seals the space between the support rings. The surface area of the support rings can be selectively chosen to direct and control pressure forces within the compressor system.

11 Claims, 7 Drawing Sheets

COMPRESSOR COMPONENTS SUPPORT SYSTEM

FIELD OF THE INVENTION

This invention relates to gas compressors and more particularly to support systems interconnecting a scroll and a downstream conduit, or other components, in a centrifugal compressor.

BACKGROUND OF THE INVENTION

Rotating compressors are well known which increase the temperature and the pressure of a gas. Common are centrifugal compressors which often include several stages of compression interconnected through conduits and intercoolers which cool the compressed gas between the plural stages. A typical compression stage includes a so-called scroll which houses an impeller. The impeller is mounted on a shaft or pinion which enters the scroll through a seal. An inlet piece is rigidly mounted to the scroll so that the impeller is positioned closely adjacent to the inlet piece and the scroll. For best efficiency, the clearances between the impeller and the scroll, and the impeller and the inlet piece, are closely maintained. During operation these clearances may be, for example, in the range of thirty thousandths of an inch. Relative motion or contact among the impeller and the scroll or the inlet piece could cause damage to the compressor and can significantly affect its efficient operation.

During operation a compressor experiences many forces as a result of temperature and pressure changes. The impeller is rotating at high rotational velocity and is affixed to the pinion which engages a gear supported in a gear box. The gear box and the components therein can expand and contract at a given rate. The scroll is typically affixed to the gear box. The scroll itself, although typically manufactured of high strength steels, tends to blow up, in an exaggerated sense somewhat like a balloon. The inlet piece is connected to inlet piping which transmits forces. The volute or discharge of the scroll is connected directly, or through interstage components, to discharge piping or intercoolers which also expand and contract under operating conditions.

It is important, therefore, to accommodate the various forces and motions while closely maintaining the clearances about the impeller.

In the prior art the scroll and downstream components have been interconnected and mounted in many ways. A common interconnection between a scroll and an intercooler involves fabricating the intercooler and the scroll with flanges and using a flanged spool piece rigidly affixed between the intercooler and spool through bolted flanged connections. This rigid assembly directly transmits loads between the intercooler and scroll. Consequently, to accommodate thermal expansions such designs have often used complex configurations to mount the intercooler in a spring like fashion from, for example, the gear box or compressor base. A concern with such designs is that the intercooler is also interconnected to other components and movement of the intercooler undesirably transmits forces to the other components. Such designs do not directly address certain forces associated with operating pressures.

An improvement upon the rigid flanged systems is the use of a nonflanged spool piece or conduit interconnected between the scroll and intercooler through peripheral grooved pipe couplings. Each end of the spool piece in such designs is spaced from the respective scroll and intercooler to form a space which will allow thermal growth between the components tending to close the space as the compressor heats up. The peripheral pipe coupling, including a coupling housing and a gasket, seals about the exterior of the components across the space, and allows movement of the components toward one another. Such peripheral grooved pipe couplings are commercially available from the Victaulic Company of America, Easton, Pa.

While the nonflanged design is an improvement in that it accommodates axial growth due to thermal forces tending to move the scroll and downstream components toward one another, it does not directly alleviate pressure forces imposed on the scroll and the downstream component, such as an intercooler. The pressure forces tend to move the scroll and the intercooler away from one another. Because of the shape and mounting of the scroll, the angles among the various components, the pressure forces, thermal forces, and resulting moments, a tendency for movement of the scroll can occur in almost any direction, undesirably changing the clearance between the scroll, the inlet piece and the impeller. It is desirable to provide structure which better accommodates pressure as well as thermal forces among centrifugal compressor components, particularly to closely maintain clearances about the impeller during operation.

SUMMARY OF THE INVENTION

This invention provides a support and interconnection system for a centrifugal compressor which better accommodates forces imposed upon the compressor components during operation. It particularly provides structure which allows thermal expansion of a scroll and downstream components, such as an intercooler in fluid communication with the scroll through a discharge conduit, and which further accommodates pressure forces imposed upon the scroll and downstream component.

In one preferred form an interstage support system is provided sealingly interconnecting the end of the scroll discharge volute and one end of an interstage discharge conduit. The other end of the conduit is connected to the nozzle of a lower mounted intercooler through the use of tie rods and a grooved pipe coupling. The circular end of the discharge volute, or an integral extension of the volute, is spaced from and concentrically aligned with the matingly sized circular end of the conduit. The axis along which the components are aligned is referred to herein and in the appended claims as an axial axis. Positioned about the end of the volute is a first upper support ring. The upper ring is sealed about the volute by a conventional O-ring and is slidable axially along the end of the volute. Preferably the end of the volute has an exterior notch large enough to accommodate upward movement of the upper ring. Although the upper ring is mounted about the volute, it is supported from the conduit. Lugs extend outwardly from the upper ring and similar lugs extend outwardly from the conduit. Tie rods bolted to the lugs rigidly affix the upper ring and the conduit so that these components move axially as one subassembly.

Similarly, a second lower ring is sealed about the end of the conduit by an O-ring which allows axial sliding movement between the lower ring and the conduit. Through lugs and tie rods, the lower ring is affixed to the volute so that these components move axially as one subassembly.

The upper and lower rings are preferably identical and are spaced from one another to form an annular gap between the two rings. A conventional grooved pipe coupling is positioned circumferentially about the rings to seal the gap.

The annular surface area of the rings at the gap is exposed to the pressure within the volute and conduit. The surface area of the rings is respectively sized to the unopposed area of the scroll and intercooler exposed to pressure forces so as to counterbalance the forces. For example, in a compressor system in which the internal flow cross sectional area from the volute, through the discharge conduit and into the intercooler forms basically a continuous cylindrical volume of cross sectional area "A". the surface area of the rings exposed to pressure is similarly sized to provide an area "A". In this manner, the pressure induced force acting upwardly on the scroll is balanced by a similar pressure induced force acting downwardly on the lower ring. Thus, the tendency due to pressure forces for relative motion between the scroll and the lower ring, interconnected through the tie rods, is alleviated. A similar relation exists between the upper ring and the discharge conduit. Pressure forces effectively counterbalance one another and thermal expansion between the scroll and discharge conduit is accommodated by allowing the free ends of the scroll and conduit to approach one another. The surface areas of the rings can also be selectively sized to be different from one another, so as to specifically account for other forces within the compressor.

BRIEF DESCRIPTION OF THE DRAWINGS

The advantages, nature and additional features of the invention will become more apparent from the following description and accompanying drawings, in which.

DESCRIPTION OF THE PREFERRED EMBODIMENTS

Figure 1:
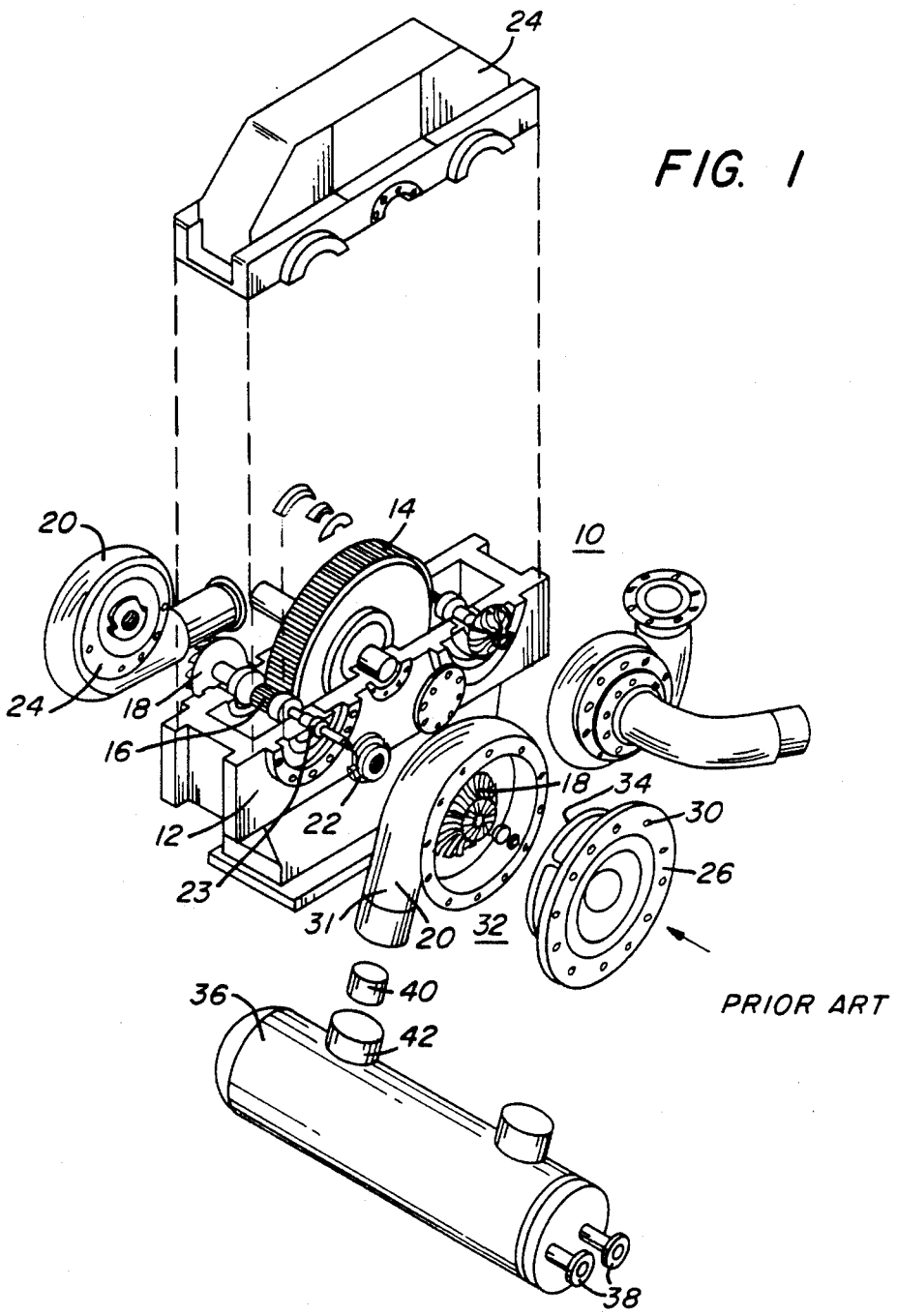
FIG. 1 is a perspective blowout view of a portion of an open impeller, multistage centrifugal compressor to which the invention is applicable.

Referring now to FIG. 1 there is shown portions of a centrifugal gas compressor indicated generally at reference numeral 10. Included is a gear box body 12 supporting a bull gear 14 driven by a prime mover not shown. The bull gear 14 drives one or more pinions 16. Supported on the pinions 16 are impellers 18 which rotate with the corresponding pinion at high speed. The pinions 16 enter a housing or so-called scroll 20 through seals 22 and bearings 23. The scrolls are mounted to the gear box 12 body through bolted interconnections indicated at numeral 24. A gear box cover 24 mounts to the top of the gear box body 12. An inlet piece 26 rigidly bolts to the scroll 20 through holes 30. The scroll 20 includes an outlet or volute 31. The volute 31 often includes a rigidly affixed cylindrical or truncated conical volute extension 46. The inlet piece 26 and scroll 20, including the volute and, if included, the volute extension 46, form what can be termed a scroll subassembly 32. The inlet piece 26 includes a shroud surface 34 matingly configured with high precision to the impeller 18. Also shown is an intercooler 36 which cools the compressed gas between the compression stages by heat transfer to another fluid which enters and exits the intercooler through ports 38. A gas enters the inlet piece 26, is compressed and directed toward the outer periphery of the scroll 20 by the rotating impeller 18, and is discharged from the volute 31 through an interstage discharge conduit 40 to the intercooler 36.

It is important to maintain the close clearances between the impeller 18 and the inlet piece 26 and the impeller 18 and the scroll 20 and to minimize any relative movement between these components. These clearances are preferably maintained in the range of 0.030 inches during operation. From a cold shut down condition to a hot operating condition, the compressor components are subjected to numerous forces, including those associated with thermal expansion and contraction and pressure loadings. For example, it is apparent that with the scroll 20 affixed to the gear box body 12 and the intercooler affixed to a base structure (not shown), the scroll 20, an intercooler inlet nozzle 42, and the discharge conduit 40 will tend, on heat up of the compressor, to thermally expand toward one another.

Figures 2A, 2B:
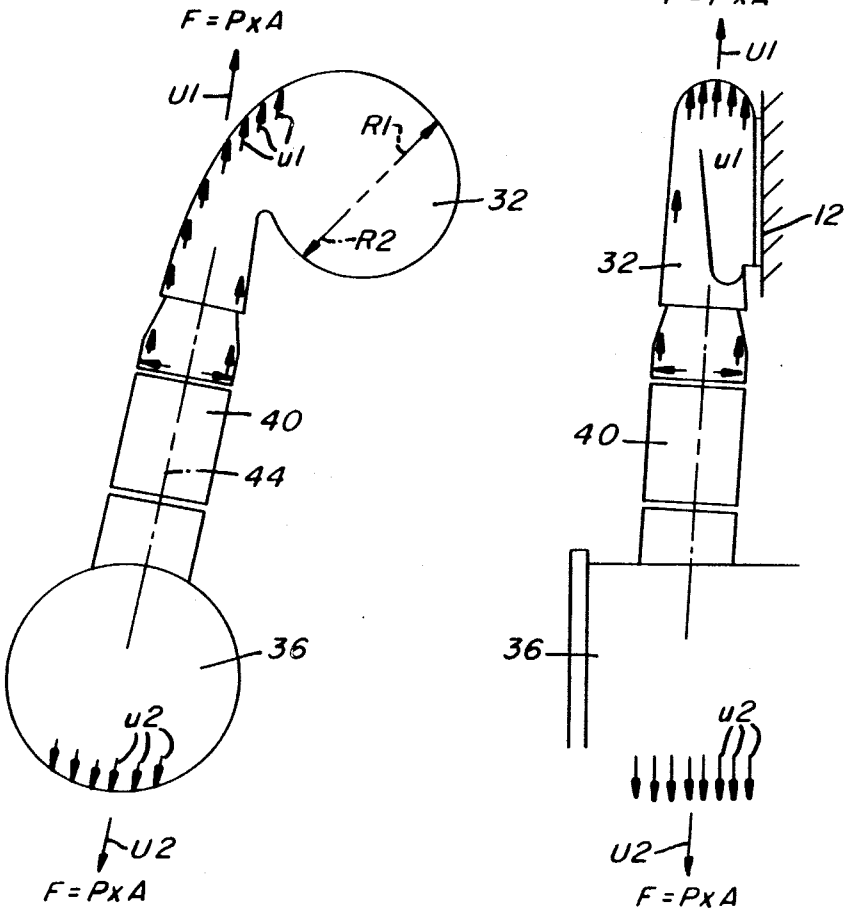
FIG. 2A is a schematic end view of portion of a centrifugal compressor indicating certain pressure induced forces.
FIG. 2B is a schematic front view of the centrifugal compressor of FIG. 2A.

Other forces are indicated on FIGS. 2A, and 2B. Upon pressurization, forces are created which are referred to herein as opposed and unopposed pressure forces. Opposed forces are defined as those pressure induced forces that are automatically counterbalanced within a component or a rigidly interconnected subassembly such as the scroll subassembly 32. Exemplary opposed forces are indicated at R1 and R2 of FIG. 2A. Unopposed pressure forces are those pressure induced forces that are not automatically counterbalanced within a given component or rigid subassembly. Unopposed pressure forces thus tend to cause relative movement among the different components exposed to the forces. Exemplary unopposed forces are indicated at U1 and U2 of FIG. 2A. U1 indicates the resultant force of the forces u1, and U2 indicates the resultant of forces u2. As shown, the force U1 reacts generally upwardly on the scroll subassembly 32 in a direction along an axial axis 44. The force U2 reacts in the opposite direction along the axis 44 on the intercooler 36. The magnitude of the equal and opposite forces is the pressure (P) times the exposed cross sectional area (A). The unopposed forces thus tend to force the scroll subassembly 32 and intercooler away from one another along axis 44. FIG. 2B shows the same unopposed forces U1 and U2. The force U1 imposes a moment on the scroll subassembly 32 tending to twist the scroll with respect to the gear box 12 and the impeller 10.

Figure 3:
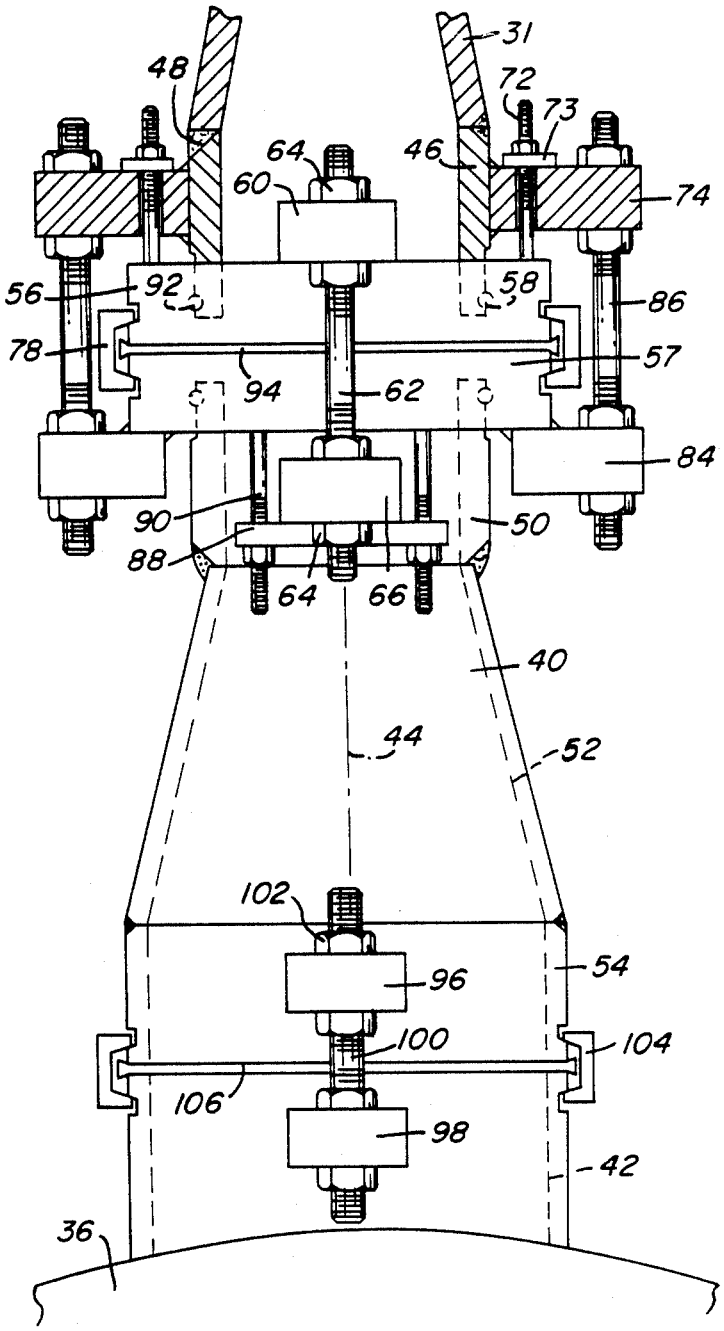
FIG. 3 is a front view of a portion of a compressor including a support system in accordance with an embodiment of the invention.

Referring now to FIG. 3, there is shown a preferred embodiment of the invention including the generally cylindrical volute extension 46 rigidly affixed, such as through a weld 48, to form an integral part of the volute 31. The discharge conduit 40 is comprised of several conduit sections 50, 52, 54 integrally welded together.

The sections 50, 54 are cylindrical and the section 52 is of truncated conical configuration. The discharge conduit 40 is thus at one end of circular cross section matingly sized and configured to the volute 31 or extension 46 and is at the other end of circular cross section matingly sized and configured to the intercooler inlet nozzle 42 which is also of circular cross section.

Slidingly mounted and sealed about the end of the volute 31 is a first upper annular support 56. The support 56 is preferably a ring sealed about the volute 31 through sealing means such as an O-ring interconnection 58 (also shown in FIGS. 5, 6 and 7). The upper support ring 56 has upper support lugs 60 welded thereto which form a part of the means for affixing the upper support ring 56 to the discharge conduit 40. The affixing means also include axially rigid tying means such as tie rods 62 which are rigidly bolted with the use of nuts 64 to discharge conduit lugs 66 extending from the discharge conduit 40. In this manner the upper ring 56 is affixed to, and supported from, the discharge conduit 40 such that the ring 56 and conduit 40 move together along the axial axis 44. The upper ring 56 is thus mounted about the volute 31, but supported from the discharge conduit 40. As described further hereinafter, a second lower annular support ring 57 is mounted about the discharge conduit 40, but supported from the volute 31.

Although the discharge conduit and supports 56, 57 are shown as being circular in cross section, it will be understood that the disclosed support system is compatible with other configurations such as compressors utilizing rectangular ducting between successive stages or components. The configuration of the supports 56, 57 would be adjusted accordingly.

Figure 4B:
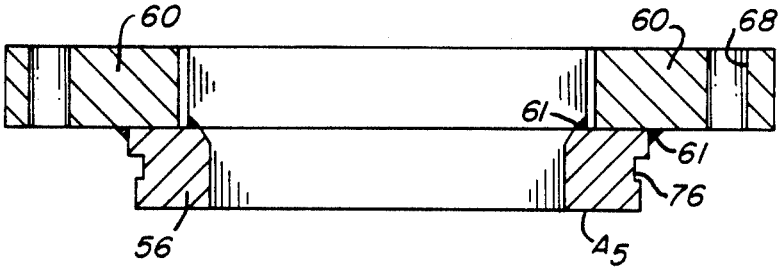
FIG. 4B is a section view taken at IVB—IVB of FIG. 4A.
Figure 4A:
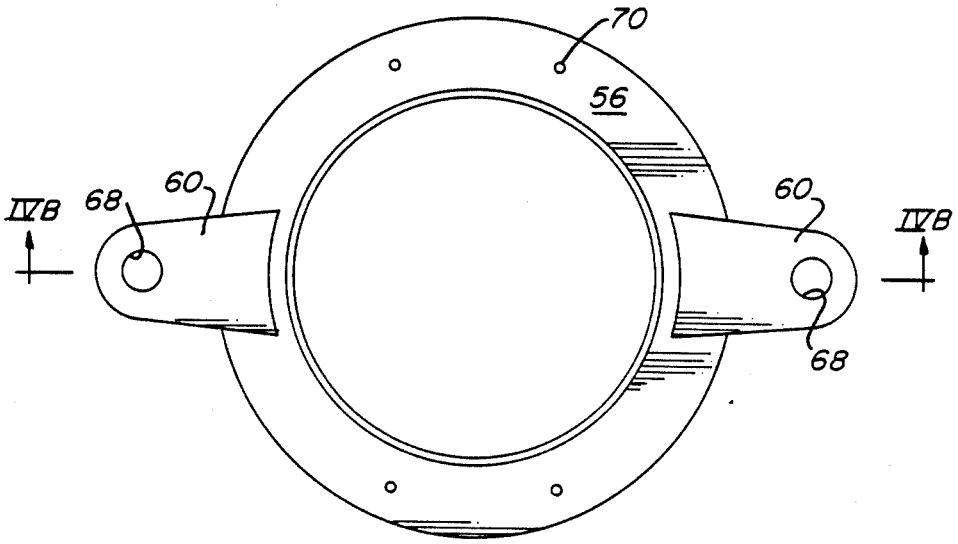
FIG. 4A is a top view of an upper support ring in accordance with the invention.

The upper support ring 56 and lugs 60 are shown best in FIGS. 4A and 4B. Although two lugs 60 spaced at 180° are shown, three lugs spaced at 120° may be utilized to restrict the tendency for relative rotation among the components. The lugs 60 are attached to the ring 56 through welds 61. The lugs 60 include apertures 68 for passage of tie rods 62. Also shown in FIG. 4A are drilled and tapped attachment holes 70 which are useful in a temporary fashion during installation of the upper ring 56 onto the volute 31. The holes 70 receive screws 72 (FIG. 3) which can be temporarily affixed to a plate 73, which plate is mounted to the volute lugs 74. The screws 72 are threaded into the holes 70 to temporarily hold the upper ring 56 in place about the volute 31 prior to complete assembly of the tie rods 62. The screws 72 are disengaged during normal operation. Also shown in FIG. 4B is a peripheral groove 76 about the upper ring 56 which receives a portion of a grooved pipe coupling 78. Upon installation of the support system and operation of the compressor, an annular surface area $A_s$ is exposed to system pressure as described further hereinafter.

Referring again to FIG. 3, the second lower ring 57 can be identical to the upper ring 56 and inverted, as is shown, or can be selectively modified specifically to present a different annular area $A_s$. The lower ring 57 shown includes lower ring lugs 84 welded to the lower ring 57. Axially rigid tying means such as tie rods 86 rigidly affix the lower ring 57 and the volute lugs 74 so that the lower ring and volute 31 move together as a rigid subassembly in a direction along the axis 44. A plate 88 mounts to the discharge conduit lugs 66 and supports screws 90 useful during installation to temporarily support the lower ring 57 about the discharge conduit 40. The lower ring 57 is installed about the discharge conduit 40, but supported through the tie rods 86 from the volute 31. The lower ring 57 can slide axially along the discharge conduit while maintaining a sealed configuration through a lower O-ring 92. The upper 56 and lower 57 rings are rotationally positioned with respect to one another so that the tie rods 86 do not interfere with the tie rods 62.

The upper 56 and lower rings 57 are spaced from one another to create a gap 94 therebetween. The gap 94 is peripherally sealed by the pipe coupling 78. The gap 94 is exposed to system pressure during operation.

The section 54 of the discharge conduit 40 is rigidly affixed to the intercooler inlet nozzle 42 through conduit lugs 96, nozzle lugs 98, tie rods 100 and nuts 102. A grooved pipe coupling 104 surrounds and seals an interface region 106 between the conduit 40 and the nozzle 42. The tie rods 100 affix the discharge conduit 40 and intercooler so that these structures move together as a unit along the axial axis 44. Alternatively, the lugs 96, 98 and tie rods 100 assembly can be eliminated. Without the tie rods 100 unopposed pressure forces will act upon the annular surface area formed by the wall thickness of the discharge conduit 40 and the intercooler nozzle 42. Where the discharge conduit 40 is merely a cylinder, the annular surface area of the wall thickness is relatively small, as are the associated pressure induced forces. However, where the discharge conduit 40 includes a truncated conical section, such as the section 52, or a bend, the surface area exposed to unopposed forces in increased and use of the tie rod 100 assembly is preferred.

Figure 5:
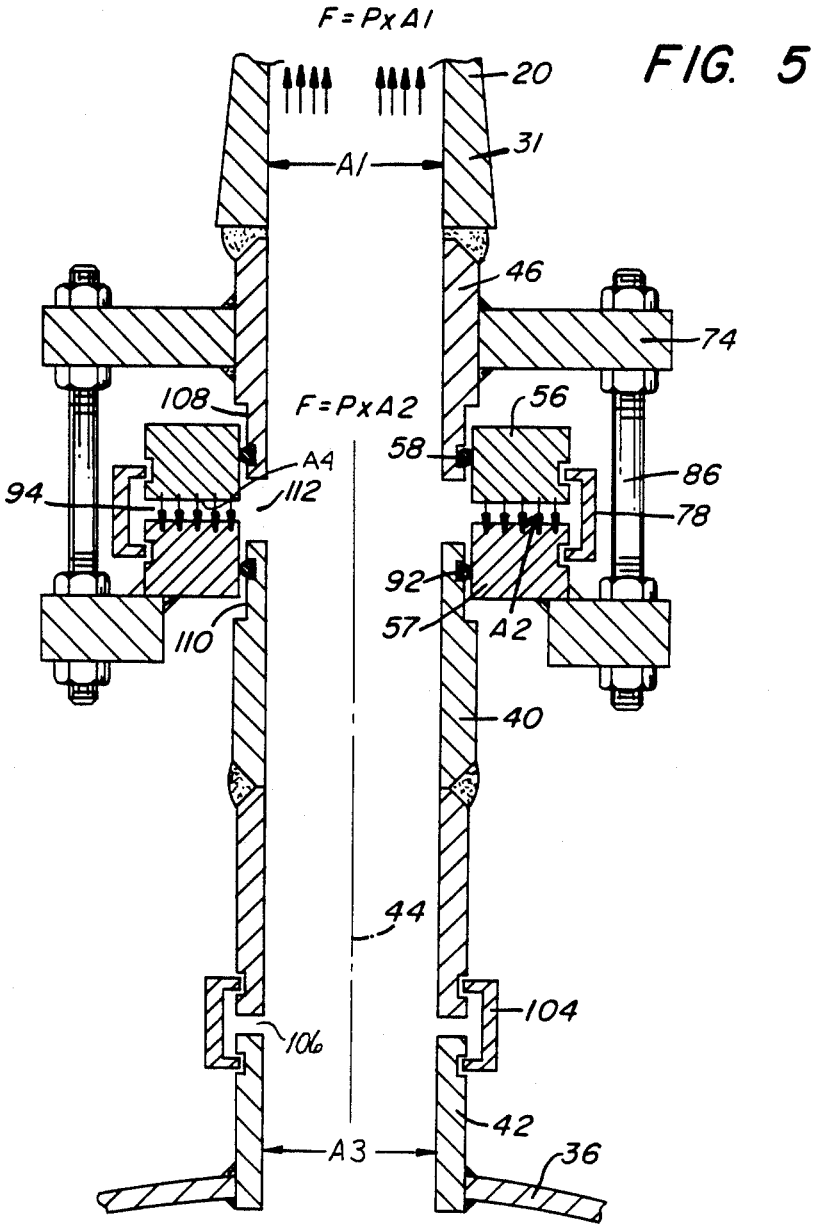
FIG. 5 is a schematic section view of a compressor and support system in accordance with the invention, showing certain pressure forces.

FIG. 5 illustrates the counterbalancing of pressure forces, particularly with respect to the scroll 20 and the lower ring 57. During operation, without the disclosed support system, the scroll would experience an unopposed pressure force (F) defined, for example, by the operating pressure (P) and the exposed unopposed cross sectional area ($A_1$). This force would be balanced by an equal and opposite force on the intercooler 36 tending to force the scroll 20 and intercooler 36 away from one another along the axis 44. A typical grooved pipe coupling will allow a limited amount of axial motion, but excessive forces can undesirably stress the coupling.

However, with the disclosed support system, the otherwise unopposed force on the scroll 20 is counterbalanced by the force (F) defined by the operating pressure (P) and the exposed annular surface area ($A_2$) of the lower ring 57. The forces are equivalent where the annular area $A_2$ is sized similar to the exposed area $A_1$. The net effect of the pressure forces is to balance the forces $A_1$ and $A_2$ resulting in no tendency for relative movement between the scroll 20 and the discharge conduit 40 or the intercooler 36. The pressure induced force previously taken by the intercooler 36 is now taken by the lower ring 57.

FIG. 5 also shows a peripheral notch 108 in the volute extension 46 and a peripheral notch 110 in the discharge conduit 40. Additionally shown is a space 112 between the end of the volute extension 46 and the end of the discharge conduit 40. The notches 108. 110 and space 112 accommodate thermal expansions between the conduit 40 and the scroll 20. For example, expansion of the scroll 20 moves the volute extension 46 downwardly in the orientation shown in FIG. 5. This movement tends to close the space 112, and also moves the lower ring 57 downwardly in the notch 110. The notches 108, 110 and the space 112 are sized sufficiently large to allow these movements due to thermal expansions. FIG. 5 also shows a configuration wherein the grooved peripheral pipe coupling 104 sealing the interface region 106 is used without tie rods.

Figure 6:
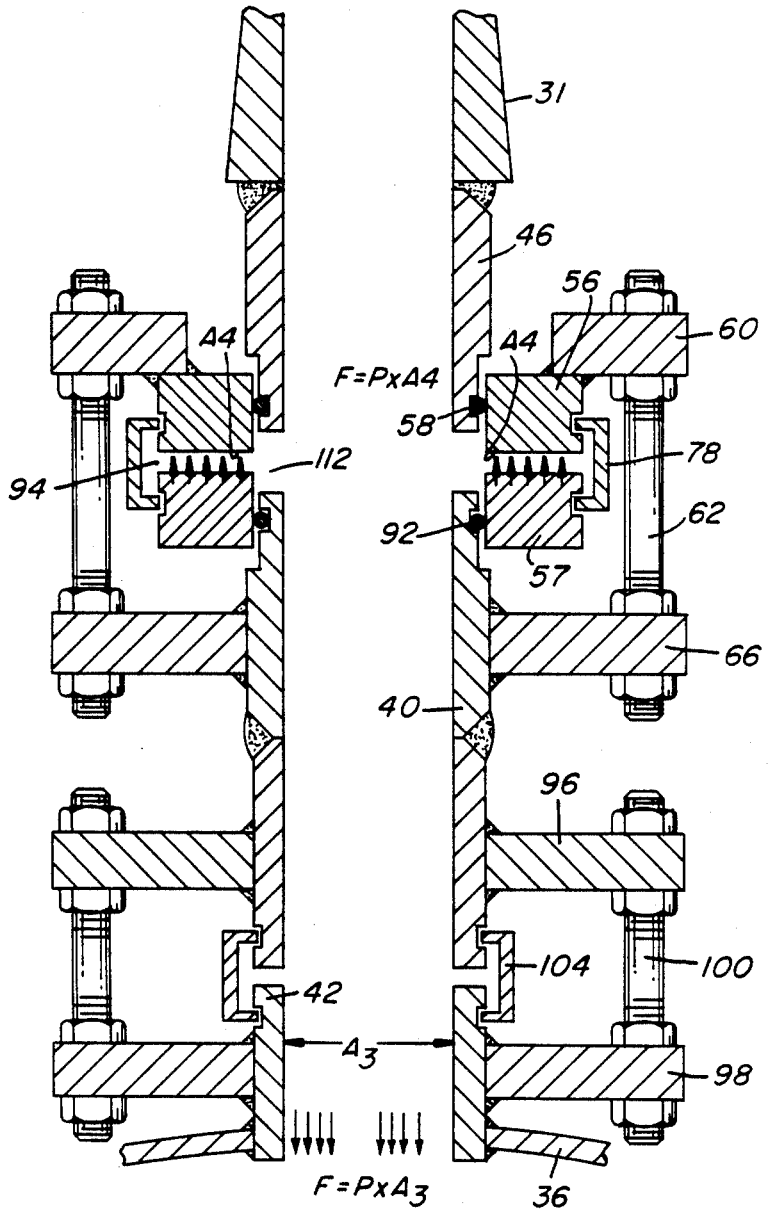
FIG. 6 is a schematic section view of a compressor support system in accordance with an embodiment of the invention showing other pressure forces.

FIG. 6 illustrates the automatic counterbalancing of pressure forces, particularly with respect to the intercooler/discharge conduit 40 and the upper ring 56. There is a downwardly acting force (F) on the intercooler defined by the operating pressure (P) and the exposed cross sectional area A3. As indicated, this force is counterbalanced by an upwardly acting force (F) on the upper ring 56 defined by the operating pressure and the annular surface area ($A_4$) of the upper ring 56. The forces are equal where the areas, $A_3$ and $A_4$, are equal.

It will be recognized conversely that the forces are unequal where the areas are not equal. It is possible, therefore, to specifically size the annular surface area of the rings 56, 57 to specifically compensate for other forces which would tend to drive the components such as forces due to weight. The annular surface area of the ring 56 can accordingly specifically be made smaller or larger than that of the ring 57.

Figure 7:
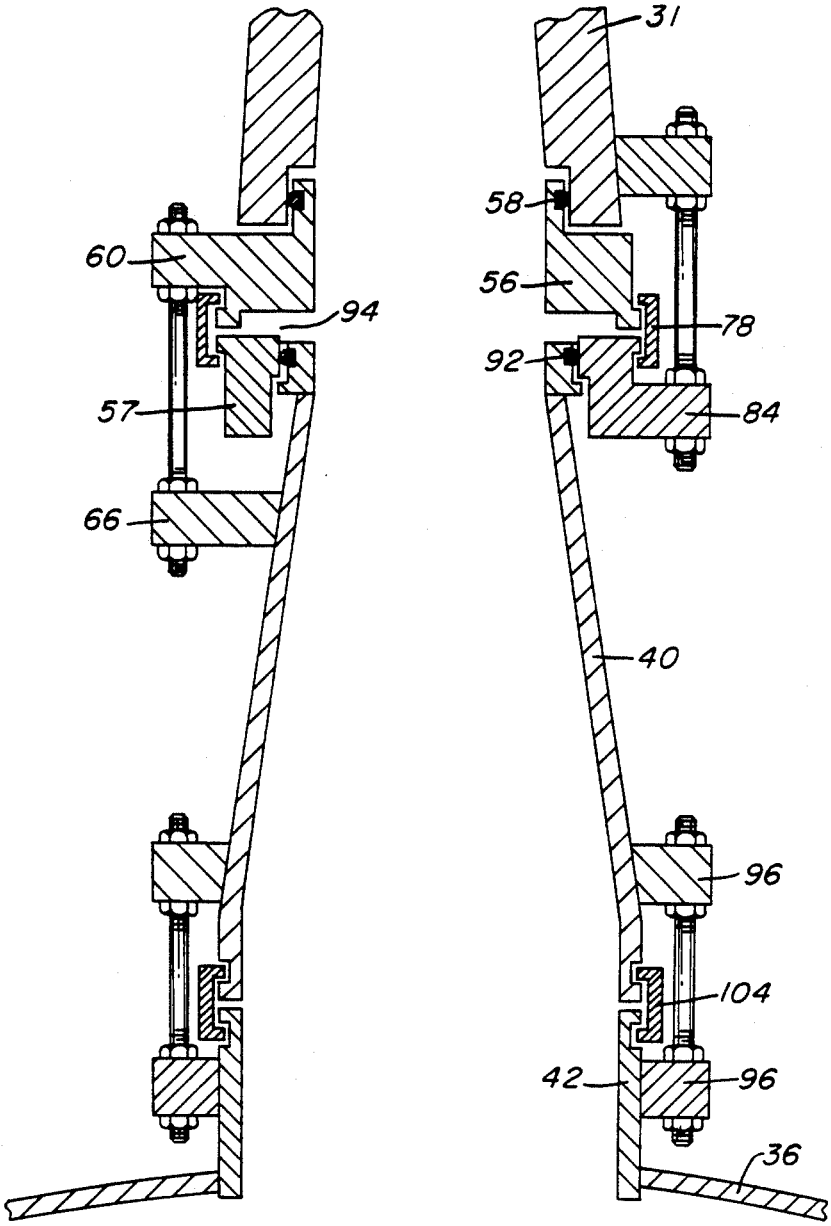
FIG. 7 is a schematic section of another embodiment of a support system in accordance with the invention.

FIG. 7 shows another embodiment in which the upper ring 56 is configured to engage the interior of the wall of the volute 31, as opposed to the exterior. The lower ring 57, as shown, is mounted about the exterior of the discharge conduit 40. Other configurations will now be apparent.

There has been disclosed an improved support system useful in centrifugal compressors. The system allows better control of pressure induced forces while simultaneously maintaining regions to accommodate thermal expansion. Selection of the surface area of the rings allows a great deal of flexibility to reduce or usefully direct the pressure forces. The system can be made self compensating with respect to pressure forces. The system can be made sufficiently compact so that it does not significantly add to the spacing among compressor components. The system allows reasonable flexibility and accessibility among the compressor components. It will be apparent that many alternate configurations are possible without departing from the spirit and scope of the invention. For example, the terms upper and lower have been used for ease of description and the system can be used in other orientations. Although the system has particularly been described with respect to the scroll and downstream components, it can be used among any of a number of a first gas conveying member and a second gas conveying member of a compressor. The supports 56, 57 can be mounted respectively to an intercooler and a discharge conduit, or to any other components experiencing unopposed pressure induced forces. The system can also be used with a direct interconnection between a scroll volute and an intercooler, or interconnection with a conduit forming a bend. Additional variations are possible. It therefore is intended that within the scope of the appended claims, the description be taken as illustrative, and not in a limiting sense.

I claim:

1. In a centrifugal gas compressor having a first gas conveying member and a second gas conveying member, an improved support system comprising:

a first annular support sealingly engaging said first member and slidable with respect thereto; a second annular support sealingly engaging said second member and slidable with respect thereto; means for sealing said first support to said second support, said sealing means allowing relative motion between said first support and said second support; means for rigidly affixing said first member to said second support; means for rigidly affixing said second member to said first support; said first member, first support, second support and second member being aligned along an axial axis, said first support being spaced from said second support so as to create a gap therebetween, and the surface area of said first member which is exposed to pressure forces acting in one direction along said axial axis being generally equivalent to the annular surface area of said second support exposed to pressure forces acting in the opposite direction along said axial axis.

2. The improved gas compressor support system of claim 1 wherein the internal cross sectional area of said second member which is exposed to pressure forces acting in said opposite direction is generally equivalent to the annular surface area of said first support which is exposed to pressure forces acting in said one direction along said axial axis.

3. The improved gas compressor support system of claim 1 wherein said first member, second member, first support and second support are circular in cross section, said second support annular surface area being called A2 and being exposed to said gap, said first member surface area exposed to said pressure forces being a circular flow area A1, and wherein A2 is generally equivalent to A1.

4. The improved gas compressor support system of claim 3 wherein said first support includes an annular surface area A4 exposed to said gap, said second member includes a circular flow area A3, and wherein A4 is generally equivalent to A3.

5. In a centrifugal gas compressor having a first gas conveying member and a second gas conveying member, an improved support system comprising:

a first annular support sealingly engaging said first member and slidable with respect thereto;

a second annular support sealingly engaging said second member and slidable with respect thereto;

means for sealing said first support to said second support, said sealing means allowing relative motion between said first support and said second support;

means for rigidly affixing said first member to said second support;

means for rigidly affixing said second member to said first support;

said first member, second member, first support and second support being circular in cross section, and said means for rigidly affixing said first member to said second support including a plurality of first member lugs affixed to said first member, a plurality of second support lugs affixed to said second support, and a plurality of tie rods removably affixed between said first member lugs and said second support lugs.

6. The improved gas compressor support system of claim 5 further comprising means for temporarily mounting said first support to said first member and said second support to said second member.

7. In a centrifugal gas compressor having a first gas conveying member and a second gas conveying member, an improved support system comprising:

a first annular support sealingly engaging said first member and slidable with respect thereto;

a second annular support sealingly engaging said second member and slidable with respect thereto;

means for sealing said first support to said second support, said sealing means allowing relative motion between said first support and said second support;

means for rigidly affixing said first member to said second support;

means for rigidly affixing said second member to said first support;

said first member, first support, second support and second member being at least in part circular in cross section and being concentrically aligned along an axial axis, said first member being a scroll having a volute, said second member being a discharge conduit, said first support being a first ring positioned about an end of said volute and sealed thereto by an O-ring type seal, said second support being a second ring positioned about an end of said discharge conduit and sealed thereto by an O-ring type seal, said first and second supports being spaced from one another to provide a gap therebetween, and said means for sealing said first support ring to said second support ring being a grooved pipe coupling peripherally positioned about said first and second support rings and said gap therebetween.

8. In a centrifugal gas compressor having a first gas conveying member and a second gas conveying member, an improved support system comprising:

a first annular support sealingly engaging said first member and slidable with respect thereto;

a second annular support sealingly engaging said second member and slidable with respect thereto;

means for sealing said first support to said second support, said sealing means allowing relative motion between said first support and said second support;

means for rigidly affixing said first member to said second support;

means for rigidly affixing said second member to said first support;

said first member, first support, second support and second member being at least in part circular in cross section and being concentrically aligned along an axial axis, said first member being a scroll having a volute, said second member being a discharge conduit, said first support being a first ring circumferentially engaging an end of said volute through an O-ring type seal, said second support being a second ring circumferentially engaging an end of said discharge conduit through an O-ring type seal, said first and second supports being spaced from one another to provide a gap therebetween, and said means for sealing said first support ring to said second support ring being a grooved pipe coupling peripherally positioned about said first and second support rings and said gap therebetween.

9. A support system for a centrifugal gas compressor of the type having an impeller rotatably mounted within a scroll and a discharge pipe in direct fluid communication with said scroll and aligned along an axis, said support system comprising:

a first support affixed to said pipe by axially rigid tying means;

a second support affixed to said scroll by axially rigid tying means;

means for creating a seal between said first support and said scroll, said means maintaining said seal upon relative motion between said first support and said scroll along said axis;

means for creating a seal between said second support and said pipe, said means maintaining said seal upon relative motion of said second support and said pipe along said axis; and means for creating a seal between said first support and said second support;

said first support being spaced from said second support so as to create a gap therebetween, said gap being in fluid communication with said scroll and pipe, the surface area of said scroll exposed to pressure forces acting in one direction along said axis being substantially equivalent to the surface area of said second support exposed to pressure forces acting in the opposite direction along said axis.

10. A method of constructing a centrifugal gas compressor having a first gas conveying member with a circular flow discharge outlet cross sectional area A1 and a second gas conveying member with a circular flow inlet cross sectional area A3, A3 being equal to A1, comprising:

aligning said first member and said second member along an axial axis with said outlet and inlet aligned and spaced from one another;

mounting a first support having a surface area A4 equal to A3 perpendicular to said axis slidingly and sealingly to said first member such that said surface area A4 is in fluid communication with said first and second gas conveying members;

mounting a second support having a surface area A2 equal to A1 perpendicular to said axis slidingly and sealingly to said second member and adjacent said first support so as to form a gap therebetween such that said surface area

A2 is in fluid communication with said first and second gas conveying members;

rigidly affixing said first support and said second member: rigidly affixing said second support and said first member; and sealing said first support to said second support across said gap.

11. In a gas compressor of the type having an impeller rotating between a scroll and an inlet piece, said scroll having a gas discharge volute in fluid communication with a discharge conduit, the improvement comprising:

a first annular support sealingly engaging said volute and slidable with respect thereto;

a second annular support sealingly engaging said discharge conduit and slidable with respect thereto;

means for sealing said first support to said second support, said sealing means allowing relative motion between said first support and said second support; means for rigidly affixing said scroll to said second support;

means for rigidly affixing said discharge conduit to said first support;

said volute, discharge conduit, first support and second support being circular in cross section, said means for rigidly affixing said first scroll to said second support including a plurality of scroll lugs affixed to said scroll, a plurality of second support lugs affixed to said second support, and a plurality of tie rods removably affixed between said scroll lugs and said second support lugs; and said second support being spaced from said first support so as to create a gap therebetween in fluid communication with said volute and discharge conduit.

* * * * *